US007408126B2

(12) United States Patent
Liu et al.

(10) Patent No.: US 7,408,126 B2
(45) Date of Patent: Aug. 5, 2008

(54) RESET LOCK FOR ELECTRONIC DEVICES

(75) Inventors: Calvin Y. Liu, Irvine, CA (US); Manrique Brenes, Corona Del Mar, CA (US)

(73) Assignee: Cisco Technology, Inc., San Jose, CA (US)

( * ) Notice: Subject to any disclaimer, the term of this patent is extended or adjusted under 35 U.S.C. 154(b) by 380 days.

(21) Appl. No.: 11/177,012

(22) Filed: Jul. 7, 2005

(65) Prior Publication Data

US 2007/0007114 A1 Jan. 11, 2007

(51) Int. Cl.
*H01H 9/28* (2006.01)

(52) U.S. Cl. ..... 200/43.01; 200/43.16; 70/14; 248/685

(58) Field of Classification Search ..... 200/43.01, 200/43.16–43.22, 50.01, 50.1, 334; 70/14, 70/18, 30, 49, 53, 58; 248/551, 685–686
See application file for complete search history.

(56) References Cited

U.S. PATENT DOCUMENTS 5,488,208 A * 1/1996 Seewald ..... 200/43.22
5,771,722 A * 6/1998 DiVito et al. ..... 70/277
6,331,934 B1 * 12/2001 Helot et al. ..... 361/686
6,389,853 B1 * 5/2002 Pate et al. ..... 701/18
6,570,758 B1 * 5/2003 Maeda ..... 361/686
6,578,394 B2 * 6/2003 Yin ..... 70/58
6,649,851 B1 * 11/2003 Hennel et al. ..... 200/43.14
6,963,037 B1 * 11/2005 Bennett et al. ..... 200/43.22

* cited by examiner

*Primary Examiner*—K. Richard Lee
(74) *Attorney, Agent, or Firm*—MacPherson Kwok Chen & Heid LLP; Greg J. Michelson

(57) ABSTRACT

Systems and methods are disclosed herein to provide a protective cover over one or more switches on an electronic device. For example, in accordance with an embodiment of the present invention, an electronic device includes a housing having a first perforation and a switch coupled to the housing. A switch cover may be placed over the switch to prevent operation of the switch, with the switch cover having a second perforation that aligns with the first perforation of the housing. A locking mechanism may be inserted at least partially through the first and second perforations to lock the switch cover to the electronic device.

19 Claims, 3 Drawing Sheets

RESET LOCK FOR ELECTRONIC DEVICES

TECHNICAL FIELD

The present invention relates generally to electrical circuits and, more particularly, to techniques for limiting access to selectable switches or buttons on an electronic device.

BACKGROUND

Electronic devices often have user-operable switches (e.g., push buttons, pressure-sensitive buttons, turnable knobs, or other types of controls) that may be used to set various functions or control various aspects of the electronic device. For example, a network device, such as a router, may have a user-operable reset button to restart the router (e.g., to clear jammed connections or clear erroneous operations) or to restore factory defaults and clear the user's settings within the router.

There may be certain drawbacks with certain user-operable switches being readily accessible. For example, information technology (IT) personnel within a company may not want a general user of a device within the company to have access to certain switches on the device. The user, using the example above for the router, may attempt to restart the router by pressing the reset button, which may erase the IT department's settings within the router. As another example, a person may illegally attempt to gain access to a network by pressing the router's reset button to restore the factory default settings and then gain access to the network through the router. As a result, there is a need for providing controllable access to one or more switches on an electronic device.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
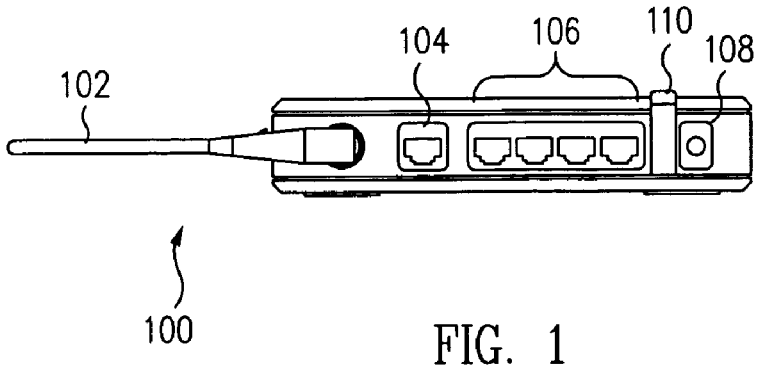
FIG. 1 shows a diagram illustrating a back view of an electronic device in accordance with an embodiment of the present invention.

FIG. 1 shows a diagram illustrating a back view of an electronic device 100 in accordance with an embodiment of the present invention. Device 100 may represent any type of electronic device having one or more switches (e.g., user-operable switches, such as for example push buttons, pressure-sensitive buttons, turnable knobs, or other types of controls).

As an exemplary implementation of device 100, a wireless router is illustrated in the figures, but this is not limiting as the principles of the present invention may be applied to any type of electronic device having a switch to be protected in accordance with one or more embodiments of the present invention. Furthermore, for this exemplary implementation, the switch to be protected is a reset button on the router, but it should be understood that the principles of the present invention are applicable to any type of switch on an electronic device and that the reset button on the router is merely an exemplary implementation.

Device 100, as an exemplary wireless router implementation, includes an antenna 102, an Internet port 104, network ports 106, a power terminal 108, and a reset cover 110. Antenna 102 is used to transmit and receive wireless communications for device 100 (e.g., a wireless router).

Internet port 104 provides an Internet connection (e.g., via a cable or DSL modem), while network ports 106 provide network connections to device 100 for external devices (e.g., computers, printers, or other types of network devices). For example, Internet port 104 and network ports 106, for example, may represent Ethernet terminals. Power terminal 108 provides a connection point for a power supply to provide power to device 100.

Reset cover 110 is used to cover a reset button (not shown) that resides under reset cover 110 on device 100. Reset cover 110 is employed to prevent the reset button from being accessed, either by accident or intentionally by an unauthorized user.

For example, if device 100 is a portable device, reset cover 110 would prevent the reset button from being accidentally depressed while a user is moving or carrying device 100. As another example, reset cover 110 may be locked in place (e.g., by an authorized user who has configured device 100) to prevent a user who is not authorized to configure or reset device 100 from using the reset button to restart or reset device 100 (e.g., to factory default settings).

Figure 2:
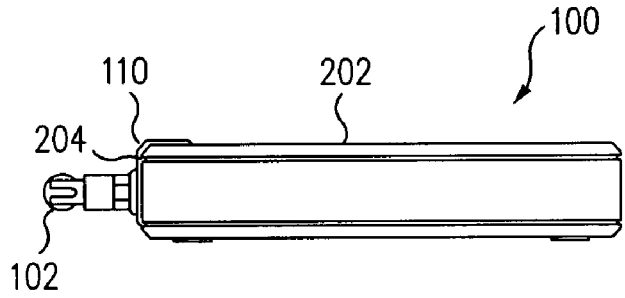
FIG. 2 shows a diagram illustrating a side view of the electronic device of FIG. 1 in accordance with an embodiment of the present invention.

FIG. 2 shows a side view of device 100 of FIG. 1 in accordance with an embodiment of the present invention. Reset cover 110 is shown in this exemplary implementation as wrapping over a top surface 202 of device 100. As described in further detail herein, reset cover 110 may be locked to device 100 (e.g., by passing a locking device through reset cover 110 and top surface 202).

Reset cover 110 may include one or more segments 204, which fit around the reset button (e.g., fit around one or more sides of the reset button) to further prevent access to the reset button. For example, segments 204 may prevent an unauthorized user from accessing the reset button by sliding a screwdriver or other thin, sharp instrument under reset cover 110 (e.g., from the side) to depress the reset button. Alternatively, reset cover 110 may be made to cover the reset button plus some additional margin on each side of the reset button to prevent unauthorized access.

Figure 3:
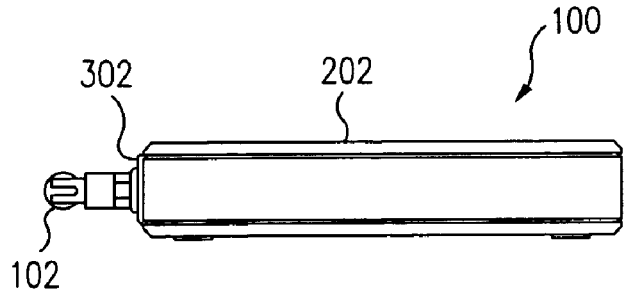
FIG. 3 shows a diagram illustrating an alternative side view of the electronic device of FIG. 1 in accordance with an embodiment of the present invention.

FIG. 3 shows a side view of device 100 of FIG. 1 in accordance with an embodiment of the present invention. A reset cover 302 is shown in this exemplary implementation as being located solely on the back side of device 100 and not wrapping over top surface 202 of device 100 as was described for reset cover 110. Reset cover 302 may be locked to device 100 by passing a locking device through reset cover 302 and the back side of device 100 (e.g., in a similar fashion as described herein for the exemplary embodiment of reset cover 110). For example, reset cover 302 may have an opening through which a locking device is passed to secure reset cover 302 to device 100.

Figure 4:
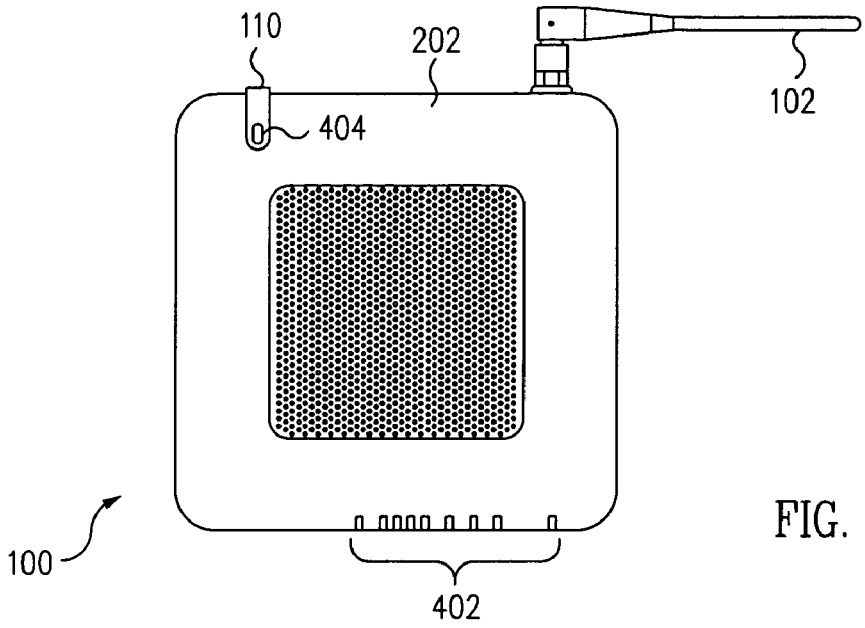
FIG. 4 shows a diagram illustrating a top view of the electronic device of FIG. 1 in accordance with an embodiment of the present invention.

FIG. 4 shows a top view of device 100 of FIG. 1 in accordance with an embodiment of the present invention. As can be seen in FIG. 4, reset cover 110 wraps over top surface 202 of device 100. Reset cover 110 includes a perforation 404 (e.g., a hole or opening) through which reset cover 110 may be locked to device 100 by a locking mechanism. Perforation 404 aligns with a perforation (not shown) in top surface 202 of device 100 to allow the locking mechanism to pass through perforation 404 and the perforation in top surface 202 to secure reset cover 110 to device 100. Thus, reset cover 110 may be secured (e.g., to the housing of device 100) and locked to device 100 to protect the reset button from unauthorized use.

As shown in FIG. 4, device 100 may also include one or more indicator lights 402 (e.g., light emitting diodes) to provide a user of device 100 with various information (e.g., on/off status, connection and transmission status, hardware error or various types of malfunctions). For example, in accordance with an embodiment of the present invention, indicator lights 402 may provide port connectivity status (e.g., wired Ethernet port connectivity), wireless support status (e.g., IEEE 802.11a, IEEE 802.11b, and/or IEEE 802.11g status), network status indication (e.g., Internet connection status), and/or whether device 100 is receiving power.

Figure 5:
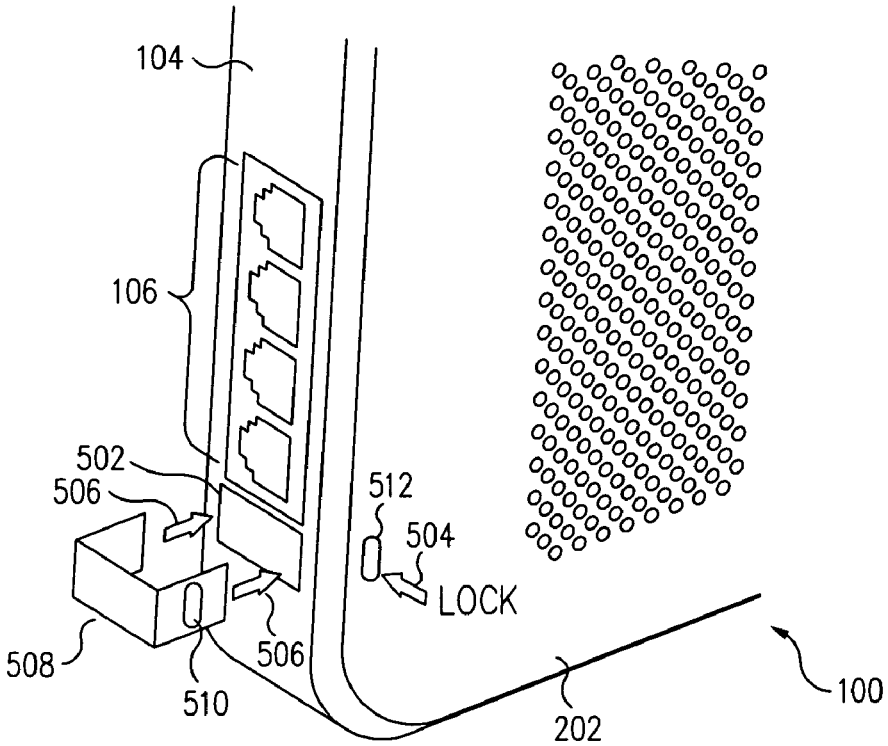
FIG. 5 shows a diagram illustrating a partial perspective view of the electronic device of FIG. 1 in accordance with an embodiment of the present invention.

FIG. 5 shows a partial perspective view of device 100 of FIG. 1 in accordance with an embodiment of the present invention. FIG. 5 includes a number of arrows 504 and 506 to illustrate various techniques in accordance with one or more embodiments of the present invention.

Device 100 includes a reset button 502 (e.g., an exemplary reset button as discussed in reference to FIGS. 1-4) and a reset cover 508 (e.g., an exemplary reset cover, providing similar functionality as reset covers 110 and 302). Reset cover 508 includes a perforation 510, which can align with a perforation 512 on top surface 202 of device 100 to allow a locking mechanism to be inserted through perforations 510 and 512 to lock reset cover 508 over reset button 502.

In general, as illustrated in FIG. 5, a user can place reset cover 508 over reset button 502 on device 100 (e.g., as indicated by arrows 506). Reset cover 508 and device 100 may be designed such that the portion of reset cover 508 that includes perforation 510 is outside of device 100 (e.g., situated on top surface 202). Consequently, a locking mechanism may be inserted (e.g., as indicated by arrow 504) through perforation 510 and then perforation 512 to lock reset cover 508 over reset button 502 and to device 100.

Alternatively, reset cover 508 and device 100 may be designed such that the portion of reset cover 508 that includes perforation 510 is within device 100 (e.g., situated under top surface 202). Consequently, a locking mechanism may be inserted (e.g., as indicated by arrow 504) through perforation 512 and then perforation 510 to lock reset cover 508 over reset button 502 and to device 100.

As an example, in accordance with an embodiment of the present invention, perforation 512 of device 100 may represent a Kensington security slot by Kensington Technology Group and meet the security slot specifications. Perforation 510 of reset cover 508 may be similarly sized to the security slot dimensions. Thus, the locking mechanism used may be a Kensington locking mechanism (e.g., a Kensington T-bar locking mechanism).

Figure 6:
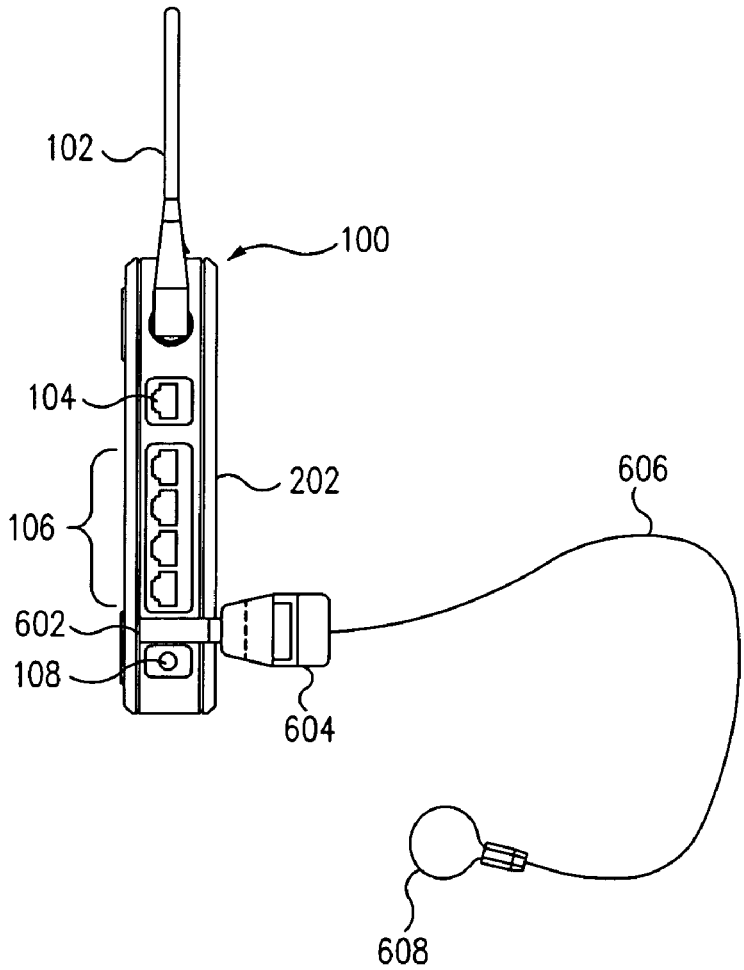
FIG. 6 shows a diagram illustrating a back view of the electronic device of FIG. 1 with a locking mechanism in accordance with an embodiment of the present invention.

As an example, FIG. 6 shows a back view of device 100 of FIG. 1 with a locking mechanism 604 in accordance with an embodiment of the present invention. As illustrated in FIG. 6, locking mechanism 604 (e.g., a Kensington locking mechanism, not necessarily drawn to scale) may be used to lock a reset cover 602 (e.g., similar to reset covers 110 and 508) to device 100, as discussed herein. In a similar fashion, locking mechanism 604 may be used to lock reset cover 302 to device 100, by inserting locking mechanism 604 through a perforation of reset cover 302 and through the housing of device 100. The locking mechanism may be unlocked and removed by using an appropriate key or a combination (e.g., sequence of numbers) associated with the locking mechanism.

Locking mechanism 604 may further include a cable 606, which is attached to locking mechanism 604. Locking mechanism 604 may be inserted through a loop 608 of cable 606, after cable 606 is wrapped around a secure object, to prevent device 100 from being carried off (as would be known by one skilled in the art).

Figure 7:
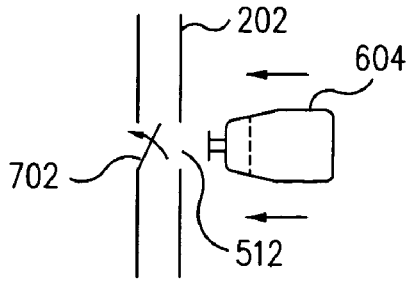
FIG. 7 shows a diagram illustrating a portion of a back view of the electronic device of FIG. 1 and a locking mechanism in accordance with an embodiment of the present invention.

Locking mechanism 604 may complete a circuit or close a mechanical switch to provide indication to device 100 that locking mechanism 604 is in place. For example, FIG. 7 shows a diagram illustrating a portion of a back view of device 100 of FIG. 1 and a portion of locking mechanism 604 in accordance with an embodiment of the present invention. As illustrated in FIG. 7, when locking mechanism 604 is inserted through perforation 512, a switch 702 is closed. Switch 702 provides an indication as to whether locking mechanism 604 is inserted into device 100.

For example, by closing switch 702, one of indicator lights 402 may light to provide a visual indication at the front of device 100 that locking mechanism 604 is in place. Switch 702 may close, for example, when locking mechanism 604 is locked into place on device 100 to positively indicate that reset cover 508 (or reset covers 110 or 302) is locked into position over the reset button.

Alternatively or in addition, information regarding the closing of switch 702 may also be provided to IT personnel or security personnel (e.g., by providing the information over a network or other communication channel linked to device 100). For example, a signaling network management protocol (SNMP) or other type of device management (e.g., management information base) may be used to manage and communicate information regarding the status of device 100 (e.g., whether reset cover 508 is locked in place). The historical status of reset cover 508 (e.g., lock and unlock times of reset cover 508) may also be stored (e.g., in a Syslog file), for example, to provide security or IT personnel with information as to when reset cover 508 was secured on device 100.

Systems and methods are disclosed herein to provide a protective cover over one or more switches on an electronic device. For example, in accordance with an embodiment of the present invention, a reset cover is disclosed to protect a reset button on a network device. The reset cover may be locked in place on the network device by a locking mechanism to prevent unauthorized use of the reset button.

Embodiments described above illustrate but do not limit the invention. It should also be understood that numerous modifications and variations are possible in accordance with the principles of the present invention. Accordingly, the scope of the invention is defined only by the following claims.

We claim:

1. An electronic device comprising:

a housing having a first perforation;

a switch coupled to the housing;

a switch cover adapted to couple with the housing to prevent operation of the switch, wherein the switch cover has a second perforation which aligns with the first perforation of the housing when the switch cover is coupled to the housing, and wherein the housing and the switch cover are adapted to receive at least a first portion of a locking mechanism inserted through the second perforation of the switch cover and the first perforation of the housing to lock the switch cover to the electronic device; and a second switch disposed within the housing and adapted to indicate when the locking mechanism locks the switch cover to the electronic device.

2. The electronic device of claim 1, further comprising the locking mechanism adapted to have at least the first portion of the locking mechanism inserted through the second perforation of the switch cover and the first perforation of the housing to lock the switch cover to the electronic device.

3. The electronic device of claim 2, wherein the locking mechanism further comprises;

a lock; and a cable coupled to the lock and having a loop, wherein the cable is adapted to wrap around an object near the electronic device, with the lock adapted to pass through the loop to secure the locking mechanism to the object prior to locking the switch cover to the electronic device.

4. The electronic device of claim 1, further comprising at least one indicator light adapted to light when the locking mechanism locks the switch cover to the electronic device.

5. The electronic device of claim 4, wherein the indicator light is activated based on a position of the second switch, and wherein the electronic device is further adapted to provide information as to a locked or unlocked state of the switch cover based on a position of the second switch.

6. The electronic device of claim 1, wherein the first perforation meets Kensington security slot specifications and the locking mechanism comprises a Kensington locking mechanism.

7. The electronic device of claim 1, wherein the switch comprises at least one of a push button, a pressure-sensitive button, and a turnable knob.

8. The electronic device of claim 1, wherein the electronic device comprises a network device and the switch comprises a reset button.

9. An electronic device comprising:

a housing;

a switch coupled to the housing;

means for preventing operation of the switch;

means for locking the preventing means to the electronic device; and means for electronically indicating that the preventing means is locked to the electronic device by the locking means.

10. The electronic device of claim 9, further comprising means for locking the electronic device to a nearby object.

11. A method of preventing access to a switch of an electronic device having a first perforation, the method comprising:

providing a cover for the switch, wherein the cover has a second perforation;

placing the cover over the switch, wherein the second perforation of the cover aligns with the first perforation of the electronic device and the cover denies access to the switch;

inserting a locking mechanism at least partially through the first perforation and the second perforation to lock the cover to the electronic device; and triggering a second switch when the locking mechanism locks the cover to the electronic device.

12. The method of claim 11, further comprising recording locked and/or unlocked status of the cover based on the triggering.

13. The method of claim 12, wherein the locking mechanism comprises a Kensington locking mechanism.

14. The method of claim 11, further comprising lighting an indicator light on the electronic device based on the triggering to indicate the cover is locked to the electronic device.

15. The method of claim 11, wherein the inserting further comprises wrapping the locking mechanism around an object near the electronic device.

16. The method of claim 15, wherein the locking mechanism secures the electronic device to the object.

17. The method of claim 11, wherein the electronic device is a router and the switch is a reset button for the router.

18. The method of claim 11, wherein a first portion of the cover surrounds the sides of the switch during the placing.

19. The method of claim 11, wherein the first perforation meets Kensington security slot specifications.

* * * * *